US006967626B2

(12) United States Patent
Apostolos

(10) Patent No.: US 6,967,626 B2
(45) Date of Patent: Nov. 22, 2005

(54) COLLAPSIBLE WIDE BAND WIDTH DISCONE ANTENNA

(75) Inventor: John T. Apostolos, Merrimac, NH (US)

(73) Assignee: BAE Systems Information and Electronic Systems Integration Inc., Nashua, NH (US)

( * ) Notice: Subject to any disclaimer, the term of this patent is extended or adjusted under 35 U.S.C. 154(b) by 0 days.

(21) Appl. No.: 10/658,186

(22) Filed: Sep. 9, 2003

(65) Prior Publication Data

US 2005/0057411 A1 Mar. 17, 2005

(51) Int. Cl.[7] ..... H01Q 11/12; H01Q 13/00
(52) U.S. Cl. ..... 343/774; 343/773
(58) Field of Search ..... 343/792.5, 785, 343/119, 790, 830, 872, 846, 773, 895

(56) References Cited

U.S. PATENT DOCUMENTS

| | | | | | |
|---|---|---|---|---|---|
| 2,368,663 | A * | 2/1945 | Kandoian | 343/790 |
| 3,618,107 | A * | 11/1971 | Spanos | 343/773 |
| 3,987,456 | A * | 10/1976 | Gelin | 343/830 |
| 4,189,731 | A * | 2/1980 | Rope et al. | 343/872 |
| 4,306,816 | A * | 12/1981 | Folland | 366/119 |
| 4,786,911 | A * | 11/1988 | Svy | 343/785 |
| 4,851,859 | A * | 7/1989 | Rappaport | 343/790 |
| 5,506,592 | A * | 4/1996 | MacDonald et al. | 343/846 |
| 5,790,080 | A | 8/1998 | Apostolos | |
| 6,313,716 | B1 | 11/2001 | Apostolos | |
| 6,323,814 | B1 | 11/2001 | Apostolos | |
| 6,373,440 | B2 | 4/2002 | Apostolos | |
| 6,373,446 | B2 | 4/2002 | Apostolos | |
| 6,404,391 | B1 | 6/2002 | Apostolos | |
| 6,480,158 | B2 | 11/2002 | Apostolos | |
| 6,492,953 | B2 | 12/2002 | Apostolos | |
| 6,697,031 | B2 * | 2/2004 | Jocher | 343/895 |
| 2003/0016181 | A1 * | 1/2003 | Engargiola | 343/792.5 |
| 2003/0025642 | A1 * | 2/2003 | Jocher | 343/790 |

* cited by examiner

*Primary Examiner*—Hoang V. Nguyen
*Assistant Examiner*—Hung Tran Vy
(74) *Attorney, Agent, or Firm*—Daniel J. Long; Robert K. Tendler

(57) ABSTRACT

A collapsible discone antenna is provided with an ultra wide band width by providing a collapsible conical skeleton cone, with the rods of the skeleton being provided with meander lines so as to effectively reduce the overall dimensions of the antenna by a factor of 2, with the antenna rods being electrically interconnected at their distal ends so as to eliminate performance degradation due to varying ground conductivities. A specialized feed configuration is used in one embodiment to feed multiple antennas stacked above a low band disc through the utilization of one or more coaxial lines which are wrapped around a ferrite toroid so that they may be passed up through the low-band disc without detuning the low band discone antenna. The use of the toroid inductor between the low-band cone and the low-band disc further reduces the low frequency cutoff of the antenna by markedly decreasing the VSWR at frequencies as low as 20 megahertz.

12 Claims, 6 Drawing Sheets

COLLAPSIBLE WIDE BAND WIDTH DISCONE ANTENNA

STATEMENT OF GOVERNMENT INTEREST

The invention described herein was made under Contract No. MDA 972.01-9.0019 with the Government of the United States of America and may be manufactured and used by and for the Government of the United States of America for Governmental purposes without the payment of any royalties thereon or therefore.

FIELD OF THE INVENTION

This invention relates to discone antennas and more particularly to a method and apparatus for providing an ultra wide band collapsible and foreshortened discone antenna, along with a specialized coaxial feed.

BACKGROUND OF THE INVENTION

It has long been the goal to be able to provide a deployable miniaturized wide band antenna which can accommodate a number of frequency bands and more particularly to be able to provide a reduced size antenna suitable for being deployed in the field whereby the antenna can be packaged in a small volume and then deployed when required.

Such antennas have application in multiple military environments in which it is desired to have a mobile base station that can be easily transported from one place to another, with the antenna being deployed easily and conveniently.

When one considers the so-called discone antennas such as those described in U.S. Pat. Nos. 4,851,859; 6,369,766; 3,983,561; 4,623,895; and 3,987,456 it will be appreciated that, for instance at a low frequency cutoff of 30 megahertz, the cone, which is typically one quarter wavelength in height, is in the order of 8 feet tall. If one seeks to lower this low frequency cutoff from 30 megahertz to 20 megahertz as is sometimes required, the height of the discone would grow from 8 feet to 11 feet.

In the past, discone antennas for low frequency bands were made either from sheet metal cones or from multiple wire rods such as described in an article by V. Lakshminarayana, Yog Raj Kubba and Me Madhusedan, entitled "Wide Band Discone Antenna" published on p. 57 of the March–April 1971 issue of the Indian Journal of "Electro-Technology."

From U.S. Pat. No. 3,987,456, we find the original discone antenna was described in U.S. Pat. No. 2,368,663 filed on May 15, 1943.

What will be appreciated is that whether the cone is made of sheet metal or whether it is made from rods which extend in a cone-shaped configuration from a central hub, the size necessary to provide a low frequency cutoff of 20 megahertz requires considerable real estate and considerable antenna height.

It is also important to understand that for such low frequency cutoff applications the disc diameter has to be 0.7 times the height of the cone.

What will be immediately appreciated is that such a structure is not easily portable and is not deconstructable for transportation in any easy way, making deployment of base stations in battlefield scenarios somewhat difficult. Moreover, the overall size of such antennas presents a highly visible target which is easily recognized both in the optical region of the electromagnetic spectrum and by radar.

For these reasons, what is required is a relatively small, ultrawide-band antenna which can go down to as low as 20 megahertz, in which the VSWR is less than 3:1. Moreover, the gain of such an antenna should be at least −3 dBc at the low end.

For those types of discone antennas which utilize rods extending out to complete the cone, it has been found that the height above ground is indeed a factor in tuning of the antenna. With a detuned antenna the VSWR can go from 3:1 to 15:1 by simply displaying the antenna at some point at or adjacent the earth's surface.

There is also a concern when multiple discone antennas are utilized to cover increasingly high bands, and that is the method of feeding such additional discone antennas without detuning the original low frequency band discone antenna. It will be appreciated that by merely passing coaxial cable up through the lower disc to connect to multiple antennas above the disc, the mere passage of the coax through the feed point of the disc causes detuning.

Thus, for a variety of reasons, there is a requirement for a small, field-deployable wide-band antenna immune from ground effects and small enough to be collapsible while at the same time presenting a reduced target when fully deployed.

SUMMARY OF INVENTION

In order to provide a conventional discone antenna with a relatively large low frequency cutoff cone, in the subject invention the cone is comprised of a number of rods extending in a cone shape out from the feed point of the cone. Interposed in selected ones of these rods are meander lines which are utilized to isolate the portions of the rods below the meander lines at the higher frequencies and to provide for an effective increase in length at the lower frequencies.

Also, it has been found that rather than utilizing rods which are not terminated at their ends or interconnected at the periphery of the cone, in the subject invention the distal ends of each of the rods are electrically connected together or bonded by a peripheral ring so as to eliminate ground capacitance effects. What this means is that the antenna when deployed can be deployed over the ground without concern about detuning and works over an infinitely conducting ground or one which is composed of sand, such as in the desert.

While the utilization of meander lines interposed on the rods to move the low frequency cutoff of the antenna down to, for instance, 30 megahertz, it is possible, utilizing a simple toroidal inductor connected between the feed point of the cone and the feed point of the disc to further reduce the low frequency cutoff of the antenna to as low as 20 megahertz. The result of the toroidal inductor is to reduce the VSWR below 30 megahertz to below 3:1.

An added benefit to the utilization of the toroid is that it forms a useful isolator for removing the capacitance effect when one or more coaxial cables are to be passed through the disc to be able to connect to one or more antennas above the disc. Thus, rather than passing multiple coaxial cables through the feed point of the disc in order to be able to connect to antennas above the disc, in one embodiment of the subject invention the coaxial cable is wound around a ferrite toroid, with the outer conductor of the coaxial cable forming the turns of the inductor. When multiple feeds are required the coaxial cables are fused together at their outer braid conductors and are then wrapped around the toroid and passed through an aperture in the disc. The inductance is provided by the toroid and the wrapped fused coaxial cables provide a non-interacting path because the outer conductor of the cables takes the place of the wire that would have to be wrapped around the toroid to achieve the ultra low frequency cutoff.

What one has achieved is that, at the point that the fused coax goes through the disc, since it is electrically coupled to the periphery of the aperture through the disc, it has no effect on the antenna. However, because the central conductors of these coaxial cables project through this aperture, as does the remainder of the coax, then one obtains two extra feed points without affecting the tuning of the low frequency band discone antenna.

What has therefore been accomplished through the utilization of the toroid and the single or fused coaxial cable feed is to make available one or more feed points above the low band antenna for whatever purpose is desired.

It will be appreciated that the overall height of a combined antenna having multiple antennas is dependent upon the size of the second or third dicone antennas. It will also be appreciated that if these antennas are to operate, for instance, between 1,000 megahertz to 20 gigahertz, the size of these antennas obviously is smaller as the frequency goes higher. Thus, the heights of such antennas do not materially contribute to the overall height of the combined antenna system.

What is therefore provided through the utilization of meander line stubs, connecting the distal ends of the skeletal elements and providing the toroidal inductor feed and the availability of feed points above the disc associated with the lowest-frequency band, is that one has a readily deployable and easily collapsible, small, ultra wide-band antenna system which can be deployed by mobile forces with ease to provide communications antennas for mobile base stations.

It will, however, be appreciated that while the subject invention is described in terms of having a fused set of coaxial cables looped around a ferrite core, a single coaxial cable looped around the core provides not only for the lower-frequency cutoff of the low band antenna but also a feed point for any antenna that is superpositioned above the disc for the low-band antenna.

In summary, a collapsible discone antenna is provided with an ultra wide band width by providing a collapsible conical skeleton cone, with the rods of the skeleton being provided with meander lines so as to effectively reduce the overall dimensions of the antenna by a factor of 2, with the antenna rods being electrically interconnected at their distal ends so as to eliminate performance degradation due to varying ground conductivities. A specialized feed configuration is used in one embodiment to feed multiple antennas stacked above a low band disc through the utilization of one or more coaxial lines which are wrapped around a ferrite toroid so that they may be passed up through the low-band disc without detuning the low band discone antenna. The use of the toroid inductor between the low-band cone and the low-band disc further reduces the low frequency cutoff of the antenna by markedly decreasing the VSWR at frequencies as low as 20 megahertz.

BRIEF DESCRIPTION OF THE DRAWINGS

These and other features of the subject invention will be better understood in connection with a Detailed Description, in conjunction with the Drawings, of which.

DETAILED DESCRIPTION

Figure 1:
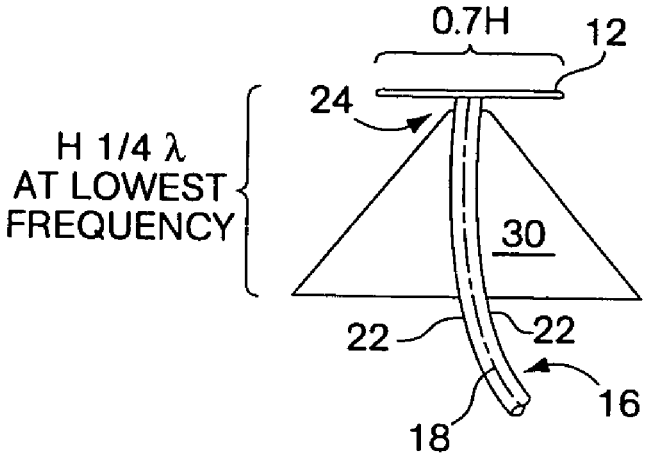
Fig. 1 (PRIOR ART)
FIG. 1 is a diagrammatic illustration of the prior art discone antenna showing that the height of the antenna at the lowest frequency is ¼ the operating wavelength.

Referring now to FIG. 1, a typical prior art discone antenna includes a cone 10 and a circular disc 12 positioned above the cone's feed point 14. The antenna is typically fed with a coaxial cable 16 such that the center conductor 18 of the coaxial cable is coupled at the midpoint 20 of the circular disc. The outer braid of the coaxial cable here illustrated at 22 is electrically coupled to an aperture 24 in the apex of the cone to complete the antenna.

Typically, the height of the antenna is a quarter wavelength at the lowest frequency of the antenna, whereas the diameter of the disc is 0.7H, with H being the height of the cone.

The discone antenna was invented during World War II to be a wide band antenna whose antenna pattern did not vary significantly with frequency and is a relatively small antenna because it is only a quarter wavelength high. It will be appreciated that the advantage at the time was to be able to have a wide-band antenna whose height was only a quarter wavelength at the low frequency cutoff of the antenna. Another feature of the discone antenna was the fact that the antenna did not need a ground plane and could therefore operate in free space.

As discussed hereinbefore, there have been many embodiments of the original discone antenna in which the cone portion, as well as the disc portion, have been made either from solid sheet stock or with rods or wires.

The problem with such an antenna, as indicated above, is that there is a requirement for an even lower low frequency cutoff of the antenna and further that the low frequency cutoff should not increase the overall size of the antenna, both because one does not need bulkiness that affects portability and also because of the fact that larger antennas can be seen both optically and by radars.

Figure 2:
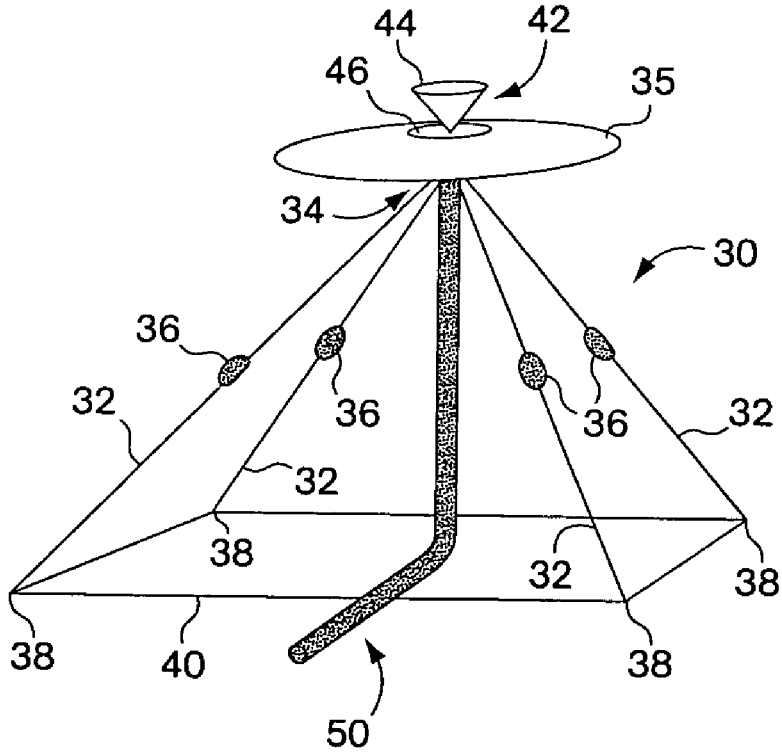
FIG. 2 is a diagrammatic illustration of the subject skeletal discone antenna utilizing meander line stubs and a peripheral wire at the distal ends of the rods of the skeletal antenna, also showing the position of an upper band discone antenna.

Referring to FIG. 2, the problems associated with the prior discone antennas have been solved by the utilization of a skeletal cone here illustrated at 30 to include a number of rods 32 which extend from the apex 34 of the cone downwardly and outwardly in a cone-shaped fashion. The low frequency cutoff of such an antenna having a low band disc 35 is that each of the rods has interposed therein a meander line stub 35 which permits the length of the rods to be foreshortened over that which would normally be required for the low frequency cutoff.

Additionally, the distal ends 38 of rods 32 are electrically interconnected as illustrated by wire 40, the purpose of which is to eliminate ground effects as noted before.

Without considering an upper band discone antenna 42, it will be appreciated that the cone, without interposed meander lines, would have a height at 30 megahertz of approximately 8 feet and at 20 megahertz a height of approximately 11 feet.

By interposing meander lines such as described in U.S. Pat. Nos. 6,313,716 and 5,790,080 issued to John Apostolos respectively on Nov. 6, 2001 and Aug. 4, 1998, incorporated herein by reference and assigned to his assignee hereof, one can reduce the overall height of the cone by approximately one-half. This is because the meander lines act as chokes above a certain frequency such that the cone itself is foreshortened for the upper frequencies but is in effect lengthened for the lower frequencies.

What will be seen is that the upper discone antenna 42 has its own cone 44 and its own disc 46, noting that the upper band discone is inverted. Note that it is immaterial which direction the cone is facing. The utilization of two discone antennas is to provide the antenna system with two bands, an upper band and a lower band, so as to provide for the appropriate wide band operation.

Figure 3:
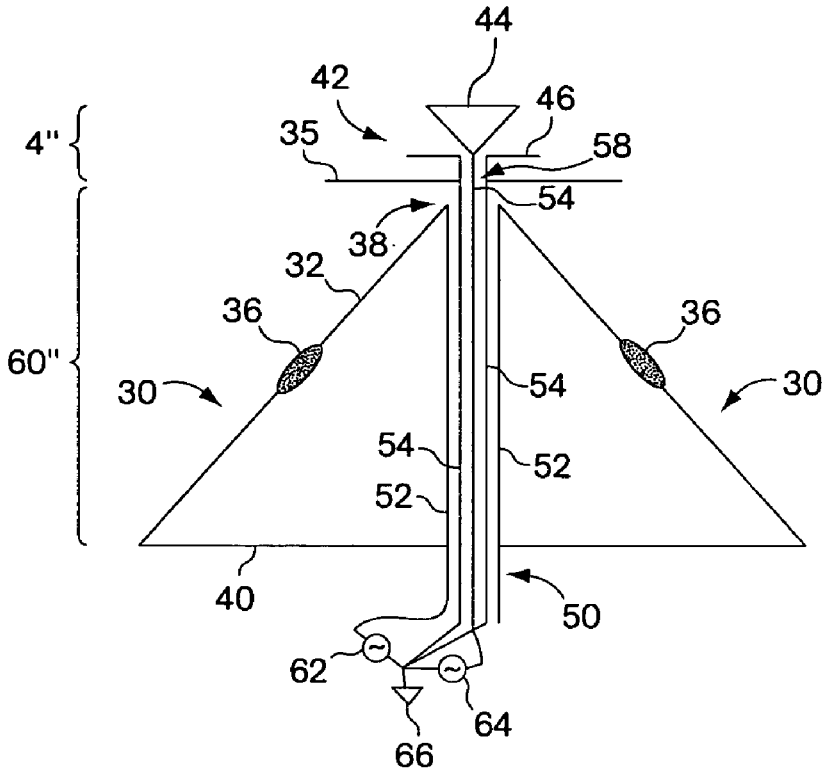
FIG. 3 is a diagrammatic illustration of the double antenna application of FIG. 2 showing a triax cable to feed the low band discone antenna and the upper band discone antenna.

As shown in FIG. 3, the two discone antennas are fed by triax cable 50, the feed scheme being now more fully described in connection with FIG. 3.

Referring now to FIG. 3 in which like elements bear like reference characters between FIGS. 2 and 3, what will be seen is that triax coaxial cable 50 has a conductor 52 connected to apex 34 of cone 32. The triax cable has a grounded braid 54 connected to disc 35 and also to disc 46. Also included in the coaxial cable is a second interior conductor 56 which is fed up through an aperture 58 in disc 35 and an aperture 60 in disc 46 to connect to the apex of cone 44.

It will be seen that signal sources 62 and 64 relate specifically to low band operation and high band operation and are connected between lines 52 and ground and line 56 and ground, respectively, thus to be able to drive the antenna in two separate bands. It will be noted that ground 66 is equipment ground as opposed to earth ground.

Figure 4:
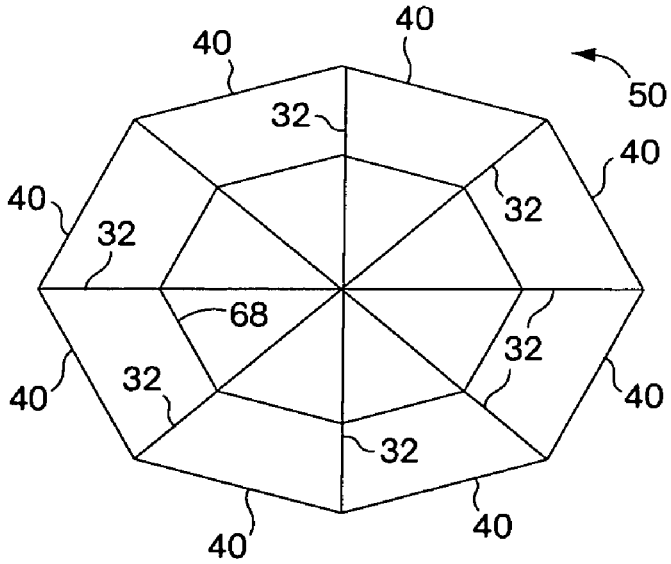
FIG. 4 is a diagrammatic illustration of the skeletal cone utilized for the low band discone antenna, illustrating the peripheral interconnection of the distal ends of the rods, as well as an intermediate ring on the rods positioned for tuning purposes.

Referring to FIG. 4, the skeletal cone in one embodiment is comprised of rods, wires or other separate electrically conductive members 32 arranged in an octagonal cone configuration with wires 40 joining the distal ends of the rods at the periphery of the cone.

Between the ends of the rods is another ring of wires 68 which are electrically connected to intermediate portions of the rods and are positioned so as to tune the low band antenna.

Figure 5:
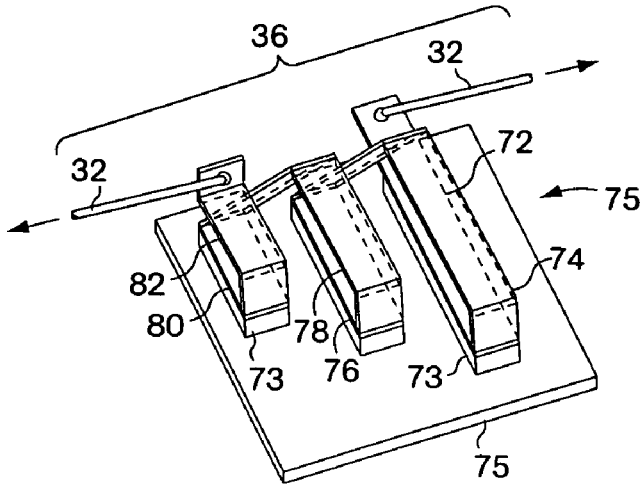
FIG. 5 is a diagrammatic illustration of a meander line stub interopposed between the ends of a rod utilized for the low band cone.

Referring to FIG. 5, what is illustrated is a meander line 70 forming stub 36 which is interposed in a rod 32, with the meander line having a low impedance section 72, a high impedance section 74, a low impedance section 76, a high impedance section 78 and a low-impedance section 80. This alternation of the high and low impedance results in the slow-wave structure described in the above patent to John Apostolos.

Note the low impedence sections rest on dielectric insulating layers 73 on top of a ground plane 75.

Figure 6:
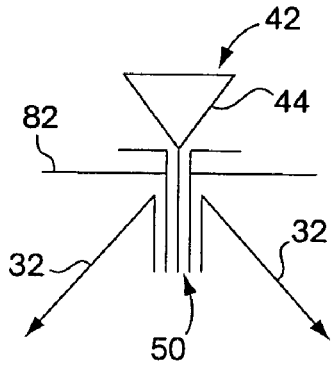
FIG. 6 is a diagrammatic illustration of the utilization of a triax cable feed where two discone antennas utilize a common disc.
Figure 7:
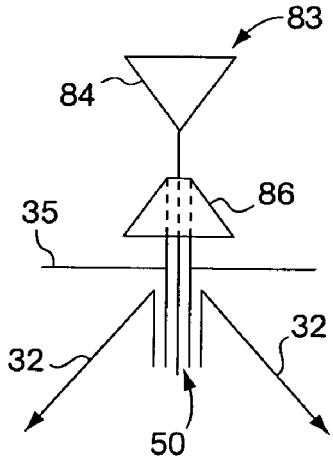
FIG. 7 is a diagrammatic illustration of the utilization of a bicone structure above a lower band disc, with the bicone being fed by a triax cable.

Referring to FIG. 6, in an alternative embodiment one can utilize a common disc 82 for both the upper band cone 44 and the lower band cone provided by the rods 32, whereas, as can be seen in FIG. 7, if one has a bicone set of antennas located above the low band discone antenna, one can have a configuration in which, with the bicones 84 and 86 pointed at each other above the lower band disc 35, one can have a trilogy of bands, each associated with a given cone. Note that the bicones can be fed with a coaxial cable having its outer braid connected to the apex of the lower cone and the center conductor connected to the apex of the upper cone.

Figure 8:
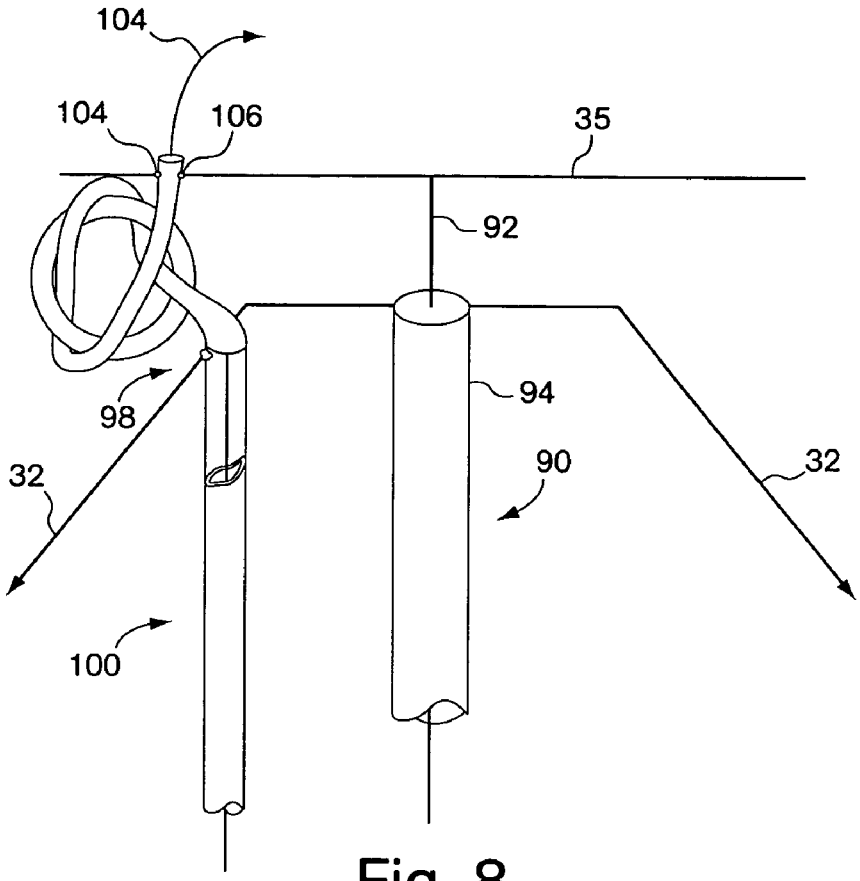
FIG. 8 is a diagrammatic illustration of the utilization of a toroidal inductor between the feed point of the low band cone and the associated disc, showing the ability to provide a feed point above the disc without detuning or other interruptions to the operation of the low band discone.

Referring now to FIG. 8, in order to further decrease the low frequency cutoff of the low band antenna and assuming, for instance, that the low band antenna has the aforementioned skeletal cone 30 along with a low band disc 35, and further assuming that the low band disc is fed by a separate coaxial cable 90 having a center conductor 92 electrically coupled to disc 35 and an outer conductor 94 connected at the apex 96 of cone 30, then by providing an aperture 98 at the apex of cone 30 to accommodate a further coaxial cable 100, one can wrap this coaxial cable about a ferrite toroid 102 with the coaxial cable end 104 exiting through an aperture 106 in disc 35 so as to present a feed 108 above disc 35.

As mentioned above, it is important to be able to provide feed points above the disc associated with the low band antenna without detuning the low band antenna or affecting its VSWR.

Figure 9:
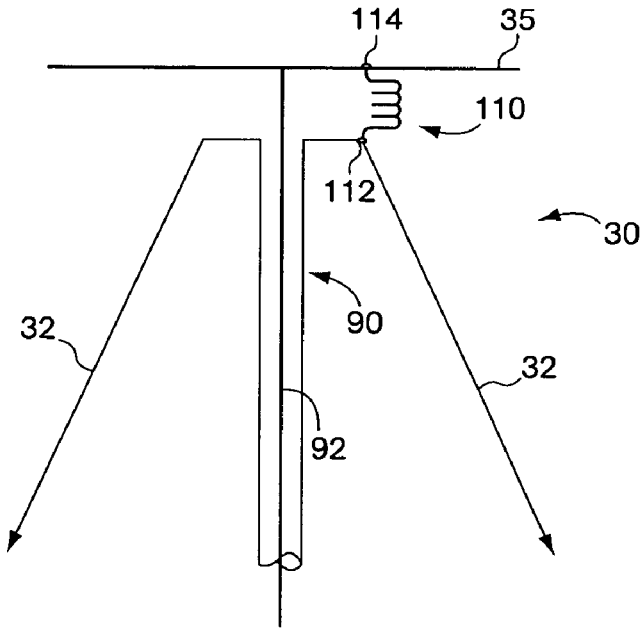
FIG. 9 is a schematic diagram of the toroidal feed embodiment of FIG. 8, showing the interposition of an inductor between the top of the cone and its associated disc.

The equivalent electrical circuit is shown in FIG. 9 in which an inductor is illustrated at 110 to be connected between point 112 on cone 30 and point 114 on disc 35.

The utilization of the inductor between points 112 and 114, enables the antenna to work down to 20 megahertz by canceling the residual capacitance associated with the antenna below 20 megahertz. With three turns on a toroid having an outside diameter of 1 inch and an inside diameter of ¾ inch and with a thickness of a quarter of an inch, one can expect inductor 110 to be a three microhenry inductor. At 20 megahertz, this is equivalent to 377 ohms or 120 pi ohms. This therefore cancels the residual capacitance and lowers the VSWR.

Put another way, the inductor provides a reactive matching component which is high pass in nature so that it does not affect the high end and extends the low end by effectively matching to the 50 ohm coaxial cable.

What will be seen is that utilizing the toroidal inductor one can lower the low frequency cutoff of the antenna regardless of whether the inductor is made out of a turn of wire around a toroid or whether the inductor is made by encircling the toroid with coaxial cable. The reason is that it is the outer conductor of the coaxial cable which forms the inductor winding wire.

The result is that the outer conductor of the coax can form the inductor winding, whereas the inner conductor or central conductor of the coax may be utilized to drive antennas above the low band disc.

Figure 10:
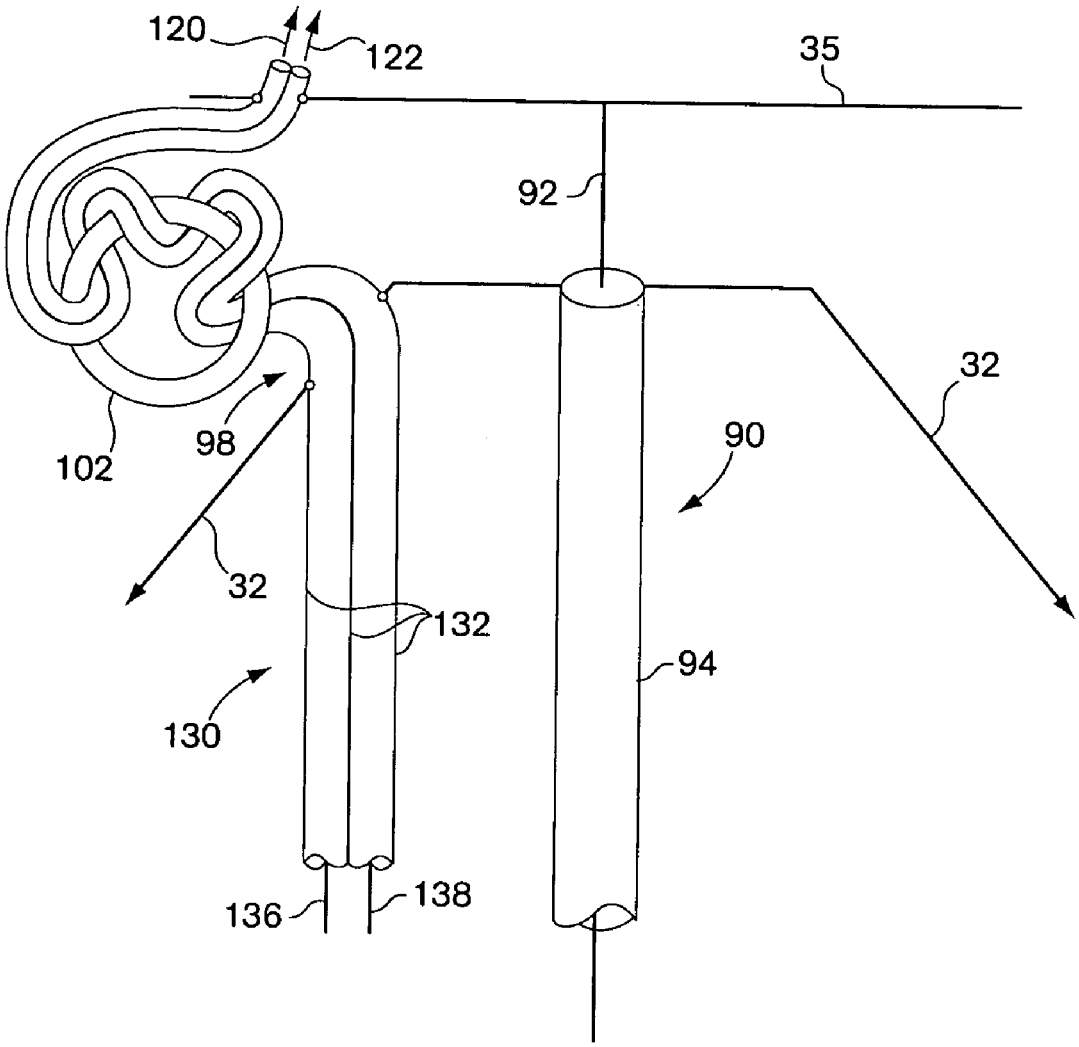
FIG. 10 is a diagrammatic illustration of the utilization of a toroid and multiple fused coaxial cables to present multiple feed points above the disc associated with the low band antenna without interfering with tuning or VSWR of the low band antenna; and, FIG. 11 is a diagrammatic illustration of an alternative embodiment of the subject invention.

Referring to FIG. 10 in which like elements have like reference characters, if one seeks to have more than one feed point above the low band disc 35, such as illustrated at 120 and 122 to be able to feed whatever antennas need to exist above this disc, one can utilize a fused coax line 130, which has its outer conductors 132 fused together electrically. The fused cables extend through aperture 98 and are wrapped around toroid 102, with center conductors 136 and 138 exiting above disc 35 to be used for whatever purpose is required. In this manner, multiple antennas can be stacked above the low band disc and driven in a convenient fashion which does not impact the performance of the low band discone.

Figure 11:
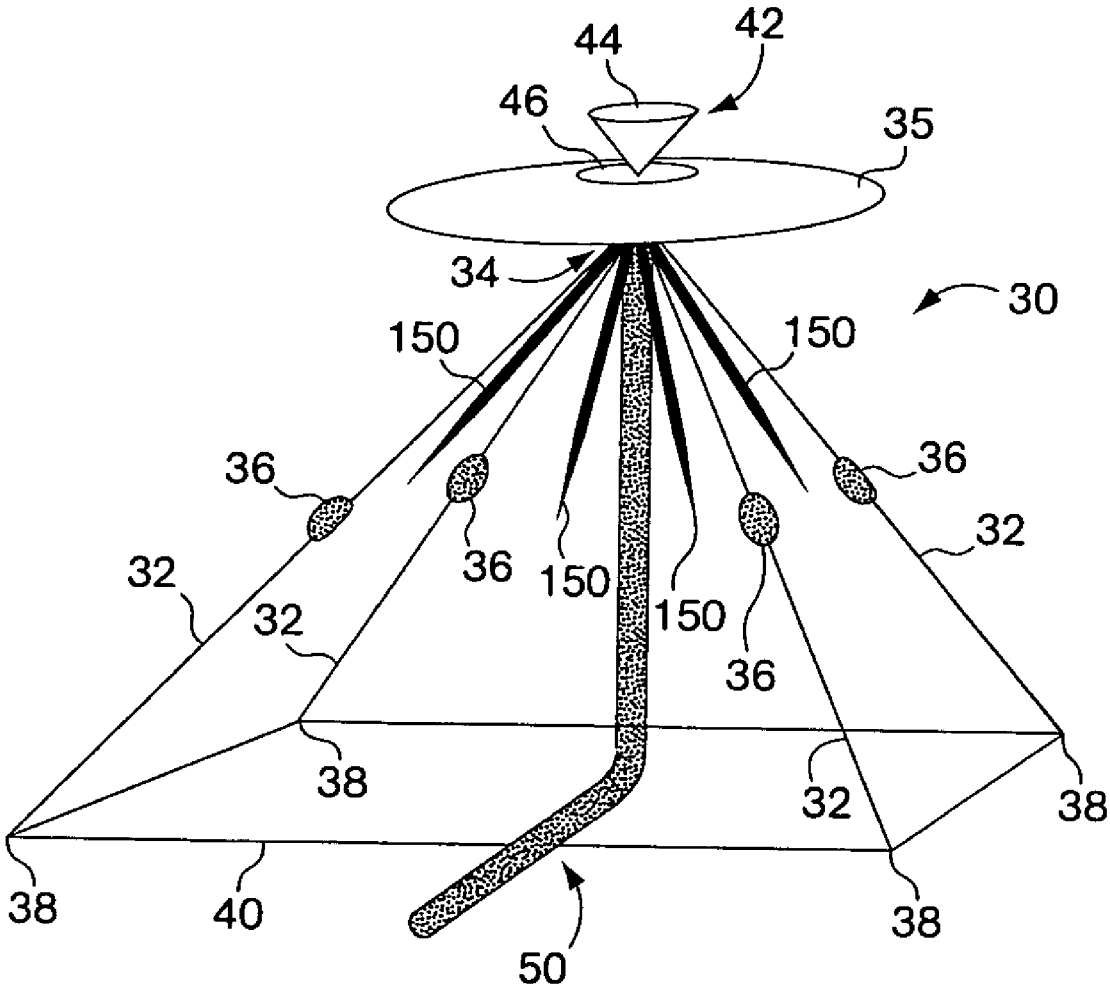

While the subject invention has been described in FIG. 2 without the use of rods which are useful in the upper frequency band to eliminate cloverleaf or other undesired antenna patterns, while it is possible to eliminate such antenna patterns by utilizing eight wires with such stubs, in an alternative embodiment as shown in FIG. 11, a series of rods 150 may be utilized in the upper frequency bands which depend from apex 34 downwardly as illustrated.

These rods provide for the desired omnidirectional pattern for the upper band and act in conjunction with wires 32 in the upper band to provide for omnidirectional coverage.

More particularly, as to he question of the number of rods at the higher frequencies (150 mHz–1000 mHz) if one has only four wires as shown in FIG. 2, the result is that the patterns become cloverleaf with 6–7 dB fluctuations. Use of eight rods/stubs ameliorates this effect. However, the cloverleaf effect can also be ameliorated by interlacing four additional short rods 150 in between the four long wires 32. These rods require no stubs. The length of the short rods is equal to the distance from the apex to where the stubs would be located if one were to use wires such as wires 32.

While the present invention has been described in connection with the preferred embodiments of the various figures, it is to be understood that other similar embodiments may be used or modifications or additions may be made to the described embodiment for performing the same function of the present invention without deviating therefrom. Therefore, the present invention should not be limited to any single embodiment, but rather construed in breadth and scope in accordance with the recitation of the appended claims.

What is claimed is:

1. A wide bandwidth discone antenna, comprising:

a circular disc;

a frusto conical cone in the form of a skeleton having elongated straight conductive members extending from the apex of the cone in a conical configuration, said apex spaced from said disc; and localized meander line stubs interposed in said conductive members so as to prevent high frequency signals from going past the point at which the localized meander line is interposed, the meander line acting as a loading inductor on the lower frequencies, whereby the low frequency cutoff of said antenna is decreased over a similarly sized antenna without said stubs.

2. The antenna of claim 1, and further including a peripheral conductive ring coupled to the distal ends of said conductive members, thus to eliminate ground effects when said antenna is deployed.

3. The antenna of claim 1, and further including a coaxial cable feed for said antenna, said coaxial cable having a center conductor coupled to said circular disc and an outside conductor coupled to said cone at the apex thereof, said center conductor extending beyond said cone to said disc.

4. The antenna of claim 1, and further including an additional antenna in spaced adjacency to said discone antenna, a coaxial cable connected to said additional antenna at one end thereof, said cone having an aperture, said coaxial cable running through said aperture, a ferrite toroid, said coaxial cable running through said aperture and looped around said toroid, said disc having a disc aperture and said cable after having been looped through said toroid passing through the aperture in said disc, thereby to eliminate any detuning of said discone antenna associated with a coaxial cable feed passing through an aperture in said disc.

5. The antenna of claim 1, and further including an inductor connected between said cone and said disc for decreasing the low frequency cutoff of said discone antenna.

6. The antenna of claim 5, and further including a coaxial cable adapted to feed an additional antenna and passing through an aperture in said disc, said coaxial cable forming one or more turns of said inductor, whereby said inductor also functions to minimize detuning associated with the passage of said coaxial cable through an aperture in said disc.

7. The antenna of claim 6, wherein said additional antenna is a dicone antenna.

8. The antenna of claim 1, and further including an inductor connected between said cone and said disc, and a number of coaxial cables, each adapted to feed a different additional antenna, said cables having their outer conductors fused together, said fused cables forming one or more turns of said inductor, with the outer conductors forming the turns of said inductor and the inner conductors feeding separate additional antennas.

9. The antenna of claim 1 and further including a second dicone antenna adjacent thereto, said disc serving as the disc for said second dicone antenna.

10. The antenna of claim 1, wherein said skeleton is collapsible.

11. The antenna of claim 1, and further including an additional dicone antenna, said discone antennas covering different frequency bands, the discone antenna having the lower frequency band having said skeleton cone with said stubs, whereby the size of said low frequency band antenna is minimized.

12. A method for reducing the low frequency cutoff of a discone antenna having a circular disc and a cone spaced therefrom, comprising the steps of:

forming the cone with a series of separate electrically conductive elongated straight members extending from the apex of the cone; and, interposing a localized meander line stub in an electrically conductive member.

* * * * *